US009468244B2

(12) United States Patent
Moltrup

(10) Patent No.: US 9,468,244 B2
(45) Date of Patent: Oct. 18, 2016

(54) BUCKLE-FREE BELT

(71) Applicant: George Patrick Moltrup, Suffolk, VA (US)

(72) Inventor: George Patrick Moltrup, Suffolk, VA (US)

( * ) Notice: Subject to any disclaimer, the term of this patent is extended or adjusted under 35 U.S.C. 154(b) by 172 days.

(21) Appl. No.: 14/571,058

(22) Filed: Dec. 15, 2014

(65) Prior Publication Data

US 2016/0165985 A1 Jun. 16, 2016

(51) Int. Cl.
*A41F 9/00* (2006.01)
*A41F 9/02* (2006.01)

(52) U.S. Cl.
CPC ..... *A41F 9/002* (2013.01); *A41D 2200/10* (2013.01); *A41D 2300/32* (2013.01); *A41F 9/025* (2013.01)

(58) Field of Classification Search
CPC ... A41F 9/002; A41F 9/025; A41D 2300/32; A41D 2200/10
USPC ..... 2/311, 321, 338
See application file for complete search history.

(56) References Cited

U.S. PATENT DOCUMENTS 4,273,130 A * 6/1981 Simpson ..... A61B 17/1322 128/DIG. 15
4,991,234 A * 2/1991 Greenberg ..... A41D 20/00 2/16
5,943,705 A * 8/1999 Sink ..... A41F 9/002 128/876
2004/0055076 A1* 3/2004 Yoo ..... A61F 7/02 2/338

* cited by examiner

*Primary Examiner* — Katherine Moran
(74) *Attorney, Agent, or Firm* — Knobbe Martens Olson & Bear LLP

(57) ABSTRACT

A buckle-free or buckleless belt is disclosed. According to various configurations, the belt can be lightweight, low profile, and highly durable. By anchoring to the wearer's clothing, the belt can resist shifting during movement. The belt is comfortable to wear regardless of the position of the wearer, and also does not impede movement or catch on other gear or equipment. In use, the belt anchors to the wearer's clothing near the wearer's hip. The belt passes under all loops and circles around the front of the body. The belt anchors to the wearer's clothing near the front of the wearer's body.

18 Claims, 5 Drawing Sheets

BUCKLE-FREE BELT

BACKGROUND

1. Field

This disclosure generally relates to clothing accessories and, more specifically, to belts.

2. Description of the Related Art

Hikers and campers, as well as military and law enforcement personnel commonly use belts to carry around a wide array of gear such as firearms, ammunition, communications equipment, and medical equipment. These belts feature a front buckle as the mechanism of adjustment and closure. In some instances they are worn with other accessories, such as a backpack or armor.

SUMMARY

In various embodiments, a buckle-free or buckleless belt that anchors to a wearer's clothing is disclosed. According to various configurations, the belt can be lightweight, low profile, and highly durable and resist shifting during movement. The belt is comfortable to wear regardless of the position of the wearer, and also does not impede movement or catch on other gear or equipment.

In at least one embodiment, a belt is provided. The belt can comprise a vertically-extending first end and a vertically-extending second end spaced apart from the first end. The belt can further comprise a horizontally- and vertically-extending elongate member comprising a first surface and a second surface facing away from the first surface. The elongate member can have an elongate-member horizontal length between the first end and the second end and an elongate-member vertical width. An optional reinforcement region can be provided on or in the elongate member. The reinforcement region can have a reinforcement-region length less than the elongate-member length and a reinforcement-region height substantially equal to the elongate-member width. The reinforcement region can comprise a vertically-extending first edge facing the first end and a vertically-extending second edge facing the second end. The belt can further comprise a first portion adjacent the first end, the first portion comprising a hook or pile first fabric on the first surface having a size defined by a first area. The belt can further comprise a second portion proximal the first edge of the reinforcement region, the second portion comprising a hook or pile second fabric on the first surface having a size defined by a second area larger than the first area, the second fabric configured, in use, to join with the first fabric. The belt can further comprise a third portion adjacent the second end, the third portion comprising a hook or pile third fabric on the second surface having a size defined by a third area. The belt can further comprise a fourth portion proximal the second edge of the reinforcement region. The fourth portion can comprise a hook or pile fourth fabric on the second surface having a size defined by a fourth area larger than the third area, the fourth fabric configured, in use, to join with the third fabric.

The foregoing elongate member can comprise a first attachment region between the first portion and the second portion. The first attachment region can have sufficient flexibility to allow, in use, for folding at least part of the first attachment region around a first attachment point on a wearer's clothing proximal a wearer's hip and joining the first fabric and the second fabric, thereby anchoring the belt at the first attachment point. The foregoing elongate member can comprise a second attachment region between the third portion and the fourth portion. The second attachment region can have sufficient flexibility to allow, in use, for folding at least part of the second attachment region around a second attachment point on the wearer's clothing proximal the wearer's navel and joining the third fabric and the fourth fabric, thereby anchoring the belt at the second attachment point.

In various embodiments the foregoing belt can have one, some, or all of the following properties as well as other properties described in this disclosure. In use, most of the first side can face away from the wearer's body, and most of the second side can face toward the wearer's body. The elongate member can comprise an elongate fabric strip. The elongate fabric strip can be a single layer. The second end can have a rounded or tapered shape. The reinforcement region can comprise one or more layers of reinforcing fabric strips. The one or more layers can comprise at least one reinforcing nylon strip. The first fabric can be a hook fabric and the second fabric can be a pile fabric. The third fabric can be a hook fabric and the fourth fabric can be a pile fabric. At least part of the reinforcement region can extend on or in the elongate member adjacent the fourth portion. The belt can further comprise a webbing material on at least part of the first surface or at least part of the second surface.

In at least one embodiment, a belt is provided. The belt comprises a first end and a second end spaced apart from the first end. The belt can comprise an elongate member extending between the first end and the second end, comprising a first surface and a second surface facing away from the first surface. The belt can comprise a first portion adjacent the first end. The first portion can comprise a first means for joining on the first surface. The belt can comprise a second portion spaced apart from the first portion by a first attachment region of the elongate member. The second portion can comprise a second means for joining on the first surface. The second joining means can be compliant with the first joining means. The first attachment region can be sufficiently flexible to allow, in use, for folding at least part of the first attachment region around a first attachment point on a wearer's clothing and joining the first joining means and the second joining means, thereby anchoring the belt at the first attachment point. The belt can comprise a third portion adjacent the second end, the third portion comprising a third joining means on the second surface. The belt can comprise a fourth portion spaced apart from the third portion by a second attachment region of the elongate member, the fourth portion comprising a fourth joining means on the second surface, the fourth joining means compliant with the third joining means, and the second attachment region having sufficient flexibility to allow, in use, for folding at least part of the second attachment region around a second attachment point on the wearer's clothing and joining the third joining means and the fourth joining means, thereby anchoring the belt at the second attachment point.

In various embodiments the foregoing belt can have one, some, or all of the following properties as well as other properties described in this disclosure. In use, most of the first side faces away from the wearer's body and most of the second side faces toward the wearer's body. The elongate member can comprise an elongate fabric strip. The elongate fabric strip can be a single layer of nylon. The second end can have a rounded or tapered shape. The belt can further comprise a reinforcement region on or in the elongate member. The reinforcement region can have a length less than a length of the elongate member. The reinforcement region can comprise a first edge facing the first end and a second edge facing the second end, the second portion proximal the first edge, and the fourth portion proximal the second edge. The reinforcement region can overlap a midpoint of the elongate member.

It should be understood that, while it is highly desirable the belt anchor to the wearer's clothing at two attachment points, such a configuration is optional. In certain configurations, the belt can anchor to a wearer at one attachment point.

BRIEF DESCRIPTION OF THE DRAWINGS

Example embodiments that implement the various features of the disclosed belts and associated methods will now be described with reference to the drawings. The drawings and associated descriptions are provided to illustrate embodiments and not to limit the scope of the disclosure.

Figure 1A:
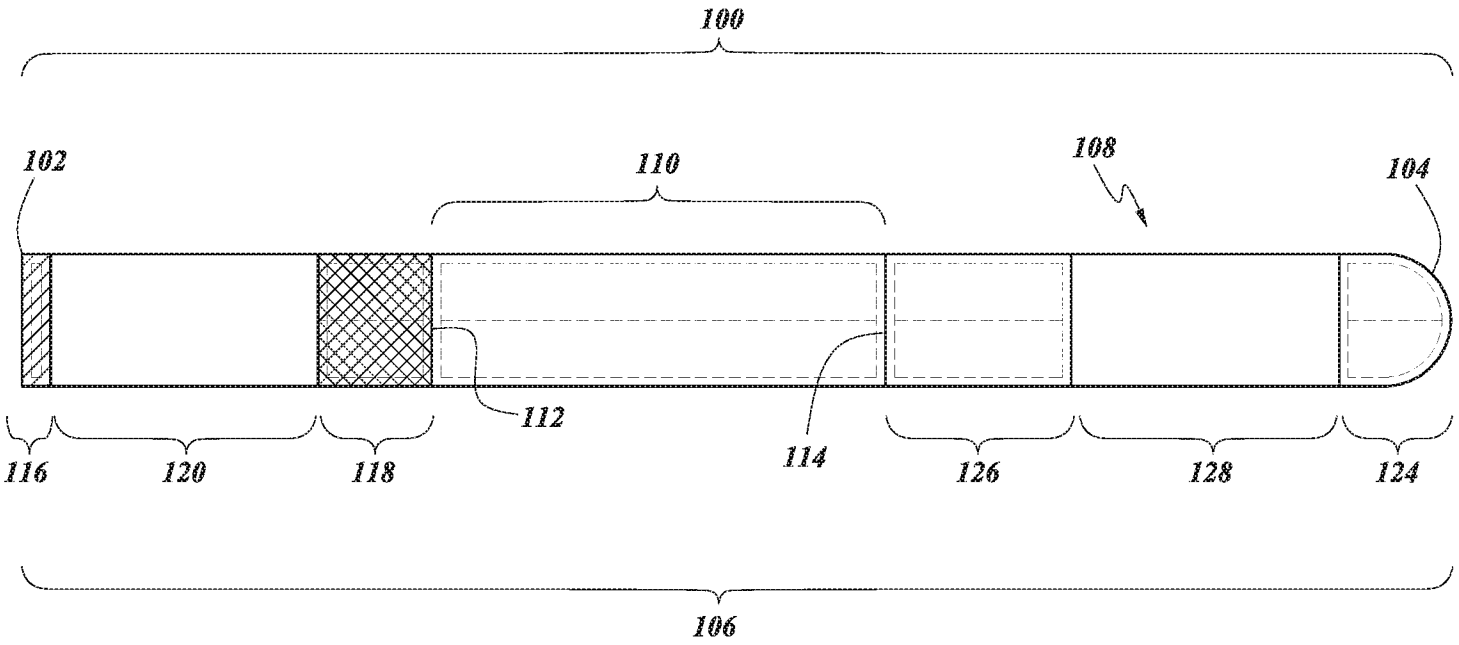
FIG. 1A is an exterior view of a belt according to at least one embodiment.

Throughout the drawings, reference numbers are frequently reused to indicate correspondence between referenced (or similar) elements. Nevertheless, the use of different numbers to indicate certain elements does not necessarily indicate that these elements are dissimilar or do not correspond with each other.

DETAILED DESCRIPTION

The following detailed description discloses belts and corresponding methods of use. It should be appreciated that the embodiments discussed below represent examples of suitable configurations, and the components can be resized and/or reconfigured as desired to produce a desired embodiment or effect. For example, the figures may show certain features on a left side or a right side of the belt. These features can be reversed so that features are placed on the opposite side of the belt. Such modifications are within the scope of the disclosure.

Belt

This disclosure relates to clothing accessories and, more specifically, to belts. More particularly, this disclosure relates to belts for use in tactical applications, such as military law enforcement applications, and to belts for use in civilian applications, such as recreational applications.

Certain embodiments include the inventive realization that belts with front buckles suffer from a number of drawbacks. For example, it was realized that, although tactical belts with front buckles function to hold gear and generally displace equipment weight on the wearers' waist, they are not designed to provide adequate freedom of movement in consideration of the operating environment that military and law enforcement find themselves in. It was also realized that the front buckle can bind on gear and catch on armor which impedes the wearers' movements. Likewise, in a recreational camping/hiking environment, the belts catch on backpack waist straps and other accessories. It was further realized that common tactical belts were not designed for wear while lying in the prone position, where the front buckle pushes into the wearers' stomach area causing discomfort and pain. Additionally, it was realized that tactical belt buckles are typically metallic and can rust and degrade when exposed to the environment, especially seawater submersion. When this occurs, the belt can no longer be properly secured and must be repaired or replaced. It was also realized that a belt buckle adds additional weight, which is highly undesirable when carrying other gear or equipment. It was further realized that tactical belts also have a free hanging end on the outward face of the belt that, through the course of use, becomes worn and frayed. Eventually, the belt no longer stays in place and the securing mechanism is compromised. This causes shifting of the belt, which can also impede movement and cause additional risk of catching on other gear.

Aspects of this disclosure reflect the inventive identification of a need for a buckle-free, lightweight, low profile, highly durable belt that does not shift during movement, is comfortable to wear regardless of the position of the wearer, and also does not impede movement or catch on other gear or equipment.

FIG. 1A shows an example belt 100 according to at least one embodiment. In particular, FIG. 1A shows an exterior perspective of the belt 100. The belt 100 comprises a first end 102 and a second end 104 spaced apart from the first end 102. When in use on a wearer, the first end 102 and the second end 104 can be vertically-extending. In the example of FIG. 1A, the second end 104 is optionally rounded to prevent fraying and protrusion of edges after internal closure and/or to facilitate passing the second end through belt loops. Nevertheless, both ends can be rounded, or neither end is rounded in various embodiments.

The belt 100 further comprises an elongate member 106 extending between the first end 102 and the second end 104. When in use on the wearer, the elongate member 106 can extend horizontally between the first end 102 and the second end 104. The span of the elongate member 106 between the first end 102 and the second end 104 can define a horizontal length. Nevertheless, horizontal length is a broad term and is to be given its ordinary and customary meaning to one skilled in the art and can include spans that are less than the distance between the first end 102 and the second end 104. The elongate member 106 can also have a vertically-extending dimension. The span of the elongate member 106 between an upper periphery and a lower periphery can define a vertical width. Nevertheless, vertical width is a broad term and is to be given its ordinary and customary meaning to one skilled in the art and can include spans that are less than the distance between the upper and lower periphery. The elongate member 106 includes a first surface 108.

The first surface 108 can include one or more layers of fabric. Fabric is a broad term and is to be given is ordinary and customary meaning to one skilled in the art and includes, without limitation, fibrous and non-fibrous materials including woven, knitted, felted, and extruded materials. In at least one embodiment, the fabric is a single layer fabric. The fabric is advantageously a durable fabric. Durable is a broad term that is to be given its ordinary and customary meaning to one of skill in the art and can be characterized, for example, by one or more of tear resistance, color retention, abrasion resistance, and the like. Desirably, the first surface member 108 is sufficiently flexible to fold such that it can be wrapped through a belt loop. Particularly suitable fabrics include nylon, blends of nylon and one or more additional synthetic fibers, nylon-natural fiber blends, such as nylon-cotton blends, polyester, blends of polyester and one or more additional synthetic fibers, polyester-natural fiber blends, polypropylene, blends of polypropylene and one or more additional synthetic fibers, and polypropylene-natural fiber blends. In at least one embodiment, the fabric is CORDURA® nylon. Nevertheless, it should be understood that other materials not including nylon are also suitable for use.

The belt 100 of FIG. 1A can optionally include a reinforcement region 110. The reinforcement region 110 can desirably provide additional strength, durability, and/or stiffness to the belt 100. The reinforcement region 110 can have a length less than the length of the elongate member 106. In some embodiments, the reinforcement region 110 can have a width substantially equal to the width of the elongate member 106. The reinforcement region 110 can comprise a vertically-extending first edge 112 facing the first end 102 and a vertically-extending second edge 114 facing the second end 104. The reinforcement region 110 can be on or in the elongate member 106. For example, in certain embodiments, the reinforcement region 110 can include one or more layers of fabric sewn onto the elongate member 106. The reinforcement region 110 could include one or more material layers, such as a plastic sheet, inserted into a pocket in the elongate member 106. Advantageously, the reinforcement region 110 is positioned across a midpoint of the elongate member 106. Nevertheless, the reinforcement region 110 can be positioned where reinforcement is necessary or desirable.

The belt 100 further includes a first portion 116 adjacent the first end 102. The first portion 116 comprises a first means for joining on the first surface 108. In at least one embodiment, the first joining means is a first fabric selected from the group consisting of a hook fabric or a pile fabric, such as VELCRO®, having a size defined by a first area. The first fabric can be attached to the first surface 108 by an appropriate technique, such as sewing or gluing. In alternative or complementary embodiments, the first joining means includes one or more male or female portions of a snap, one or more clasps, one or more grommets, and/or or one or more fabric ties. Equivalents of such structures are also contemplated.

In the example of FIG. 1A, the belt 100 includes a second portion 118 proximal the first edge 112 of the reinforcement region 110. The second portion 118 comprises a second means for joining on the first surface 108. Desirably, the structure of the second joining means is compliant with the first joining means. For example, if the first joining means is a hook fabric, the second joining means is a complementary pile fabric; if the first joining means is a pile fabric, the second joining means is a complementary hook fabric; if the first joining means includes male portions of snaps, the second joining means includes female portions of snaps; and so forth. Equivalents of such structures are also contemplated. In at least one embodiment, the second portion 118 comprises a hook or pile second fabric on the first surface 108 having a size defined by a second area larger than the first area. The second fabric can be attached to the first surface 108 by an appropriate technique, such as sewing or gluing. Certain embodiments include the inventive realization that a second area larger than the first area can improve adjustability while keeping the first area relatively small. Nevertheless, an opposite configuration in which the second area is smaller than the first area is also contemplated, as are configurations in which the second area and first area are substantially the same. The second fabric is configured, in use, to join with the first fabric.

A first attachment region 120 is shown between the first portion 116 and the second portion 118. Advantageously, the first attachment region 120 has sufficient flexibility to allow, in use, for folding at least part of the first attachment region 120 around a first attachment point, such as a belt loop, on a wearer's clothing proximal a wearer's hip and and joining the first joining means and the second joining means, thereby anchoring the belt at the first attachment point.

Figure 1B:
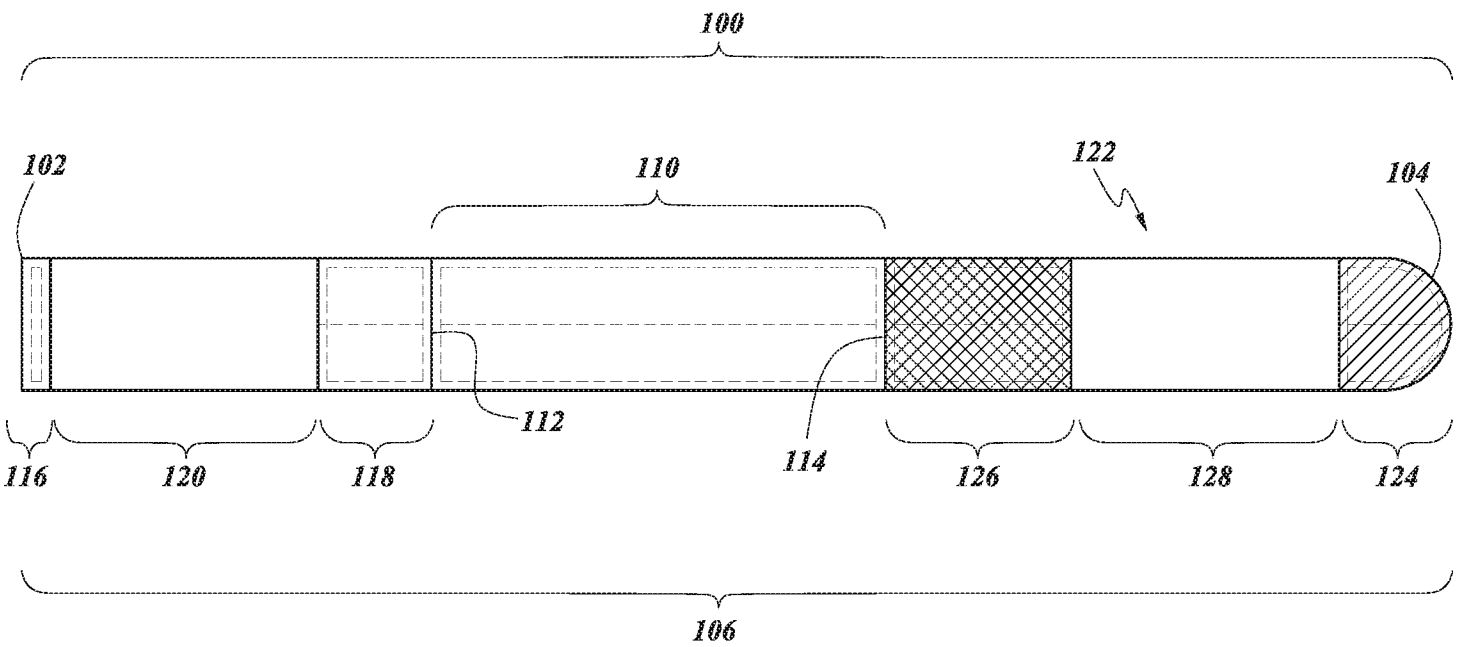
FIG. 1B is an interior view of the belt of FIG. 1A.

FIG. 1B shows the example belt 100 of FIG. 1A from an interior perspective. The elongate member 106 comprises a second surface 122 opposite the first surface 108 of FIG. 1A.

The second surface 122 can include one or more layers of fabric joined to the first surface 108, for example, by sewing or gluing. Alternatively, the first surface 108 and the second surface 122 can represents two surfaces of a single layer of fabric. As discussed above, the fabric is advantageously a durable fabric. Desirably, the second surface 122 is sufficiently flexible to fold such that it can be wrapped through a belt loop. Particularly suitable fabrics are discussed above in conjunction with the first surface 108.

As shown in FIG. 1B, the belt 100 can further include a third portion 124 adjacent the second end 104. The third portion 124 comprises a third means for joining on the second surface 122. In at least one embodiment, the third joining means is a third fabric selected from the group consisting of a hook fabric or a pile fabric, such as VELCRO®, having a size defined by a third area. The third fabric can be attached to the second surface 122 by an appropriate technique, such as sewing or gluing. In alternative or complementary embodiments, the third joining means includes one or more male or female portions of a snap, one or more clasps, one or more grommets, and/or or one or more fabric ties. Equivalents of such structures are also contemplated.

In the example of FIG. 1B, the belt 100 includes a fourth portion 126 proximal the second edge 114 of the reinforcement region 110. The fourth portion 126 comprises a fourth means for joining on the second surface 122. Desirably, the structure of the fourth joining means is compliant with the third joining means. For example, if the third joining means is a hook fabric, the fourth joining means is a complementary pile fabric; if the third joining means is a pile fabric, the fourth joining means is a complementary hook fabric; if the third joining means includes male portions of snaps, the fourth joining means includes female portions of snaps; and so forth. Equivalents of such structures are also contemplated. In at least one embodiment, the fourth portion 126 comprises a hook or pile fourth fabric on the second surface 122 having a size defined by a fourth area larger than the third area. The fourth fabric can be attached to the second surface 122 by an appropriate technique, such as sewing or gluing. Certain embodiments include the inventive realization that a fourth area larger than the third area can improve adjustability while keeping the third area relatively small. Nevertheless, an opposite configuration in which the fourth area is smaller than the third area is also contemplated, as are configurations in which the fourth area and third area are substantially the same. The fourth fabric is configured, in use, to join with the third fabric.

A second attachment region 128 is shown between the third portion 124 and the fourth portion 126. Advantageously, the second attachment region 128 has sufficient flexibility to allow, in use, for folding at least part of the second attachment region 128 around a second attachment point, such as a belt loop, on a wearer's clothing proximal a wearer's navel and and joining the third joining means and the fourth joining means, thereby anchoring the belt at the second attachment point.

Figure 4:
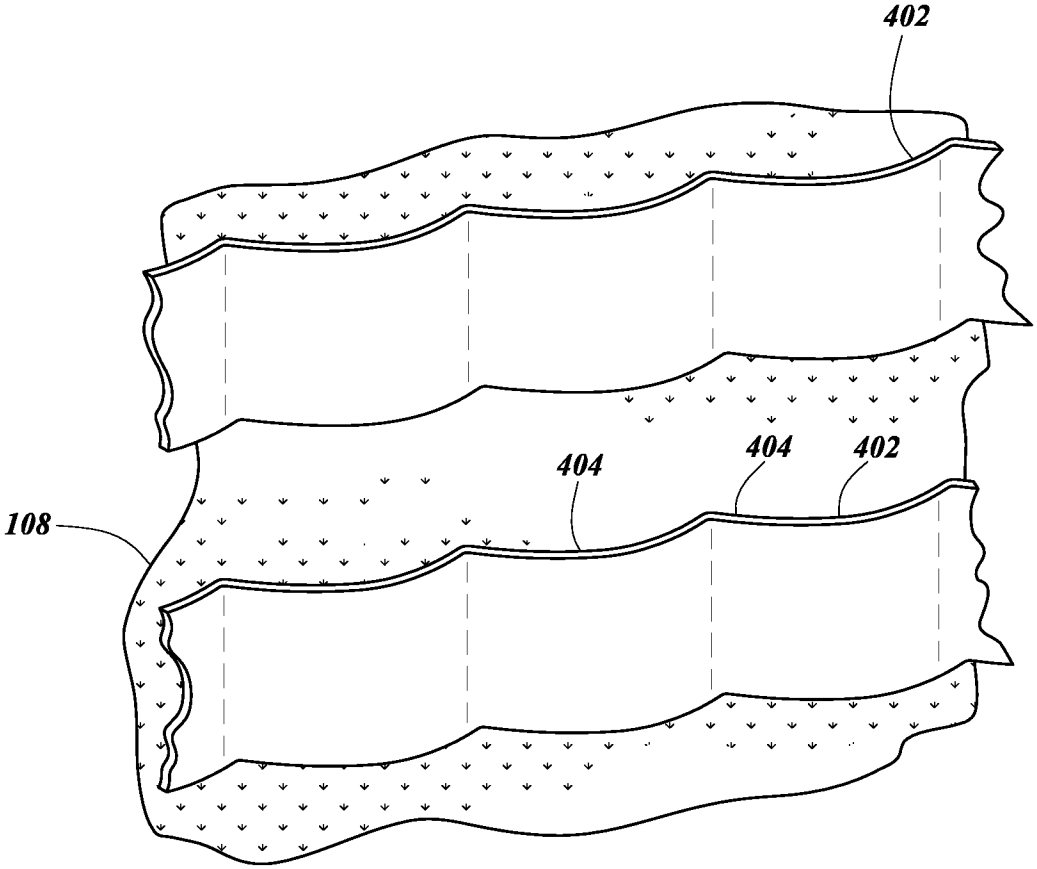
FIG. 4 is a detail showing webbing attached to the belt of FIGS. 1A and 1B.

In certain embodiments, webbing 402 can be attached to at least a portion of the first surface 108 and/or the second surface 122. The webbing can be used for holding gear items. A standardized attachment system employed by U.S. military services is the U.S. Army PALS (Pouch Attachment Ladder System) arrangement, illustrated in FIG. 4. In certain embodiments, this system employs horizontal rows 402 of 1-inch Mil-W-43668 Type III nylon webbing spaced 1-inch apart, and is attached to first surface 108 at 1.5-inch intervals. The PALS webbing defines an array of upwardly and downwardly opening loops 404. Pouches, pockets, holsters, and other accessories may be attached to the loops. Commonly, the PALS system is a component of a MOLLE (MOdular Lightweight Load-carrying Equipment) system. A PALS webbing is particularly desirable because it lays flat against the belt 100 and does not obstruct the wearer's movement when in use.

Method of Using the Belt

Figure 2:
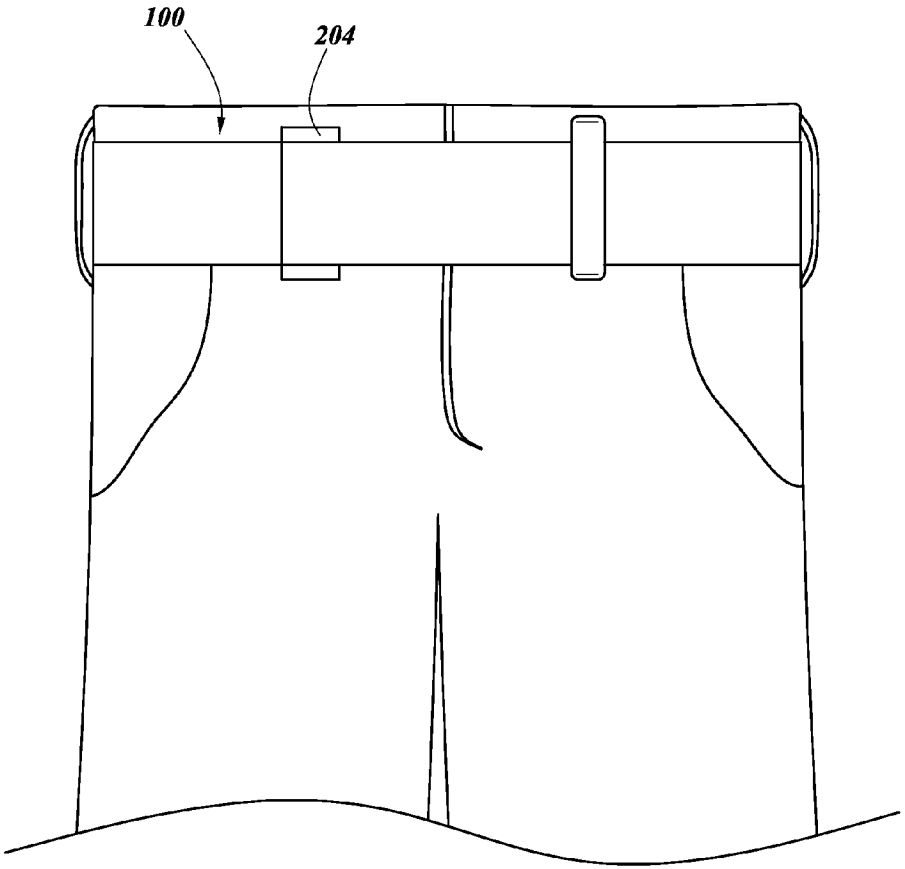
FIG. 2 is a front elevational view of the belt of FIGS. 1A and 1B as worn.

FIG. 2 shows an example of at least one embodiment of the belt 100 of FIGS. 1A and 1B in use. The belt 100 anchors internally at a first attachment point (not shown) on the left hip of the wearer. The belt 100 circles around the front of the body, passing through the belt loops of the wearer's pants. Once the belt 100 has passed all the way around the body, the belt 100 passes over a second attachment point 204 to the right of the button/zipper on the wearer's pants. The belt 100 then folds back onto itself between the body and the belt 100.

Figure 3:
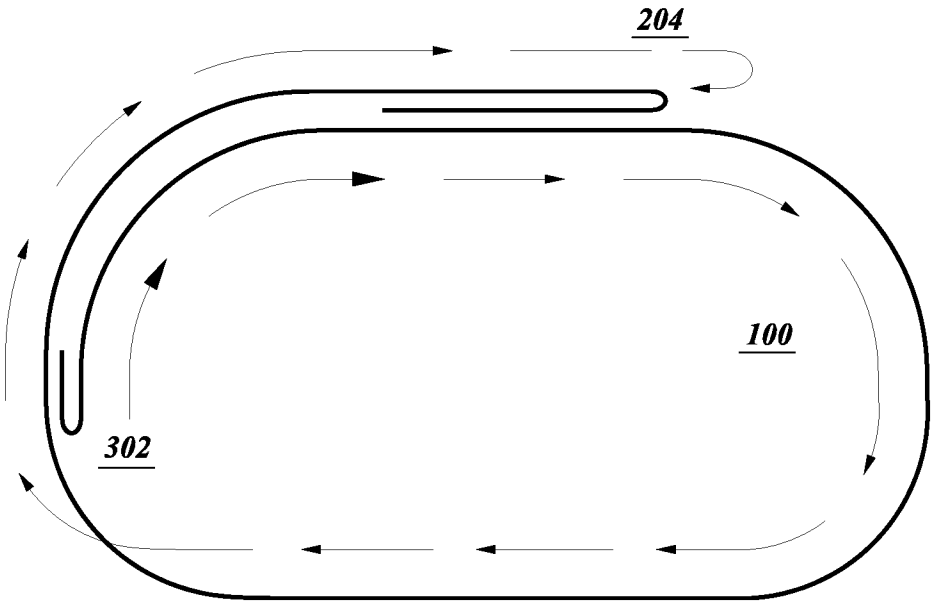
FIG. 3 is a top plan view of the belt of FIGS. 1A and 1B illustrating its path around the wearer.

FIG. 3 is a top view of the belt 100 illustrating the path around the wearer. The belt 100 anchors at first attachment point 302 and is wrapped around the body towards the front, until the belt 100 reaches the front of the pants where is it folded back onto itself and secured at second attachment point 204.

EXAMPLE

A single layer rectangular length of CORDURA® nylon having a width of two inches was utilized as the elongate member 106. The second end 104 was rounded to mitigate wear over the course of use. At first portion 116, a 1.5 inch length of hook fabric was sewn to the exterior first surface 108. At second portion 118, a 5.5-inch length of pile fabric was sewn to the first surface 108. A first attachment region 120 measuring 7.5 inches spaced the hook fabric from the pile fabric of the first portion 116 and the second portion 118. A reinforcement region 110 comprising an additional layer of CORDURA® nylon was sewn to elongate member 106. At third portion 124, a 3-inch length of hook fabric was sewn to the second surface 122. At fourth portion 126, a 6-inch length of pile fabric was sewn to the interior second surface 122. A second attachment region 128 measuring 7.5 inches spaced the hook fabric from the pile fabric of the third portion 124 and the fourth portion 126.

Terminology

The various features and methods described above may be used independently of one another, or may be combined in various ways. All possible combinations and subcombinations are intended to fall within the scope of this disclosure. In addition, certain features or method steps may be omitted in some implementations. The methods described herein are also not limited to any particular sequence, and the steps relating thereto can be performed in other sequences that are appropriate. For example, described steps may be performed in an order other than that specifically disclosed, or multiple steps may be combined in a single block or state. The example steps may be performed in serial, in parallel, or in some other manner. Steps may be added to or removed from the disclosed example embodiments. The example features described herein may be configured differently than described. For example, elements may be added to, removed from, or rearranged compared to the disclosed example embodiments. In addition, the inventions illustratively disclosed herein suitably may be practiced in the absence of any element which is not specifically disclosed herein.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Through the description and the claims, the terms "comprises," "comprising," and the like are to be construed in an inclusive sense, that is, in the sense of "including but not limited to," unless the context clearly requires otherwise.

It should be emphasized that many variations and modifications may be made to the above-described embodiments, the elements of which are to be understood as being among other acceptable examples. All such modifications and variations are intended to be included herein within the scope of this disclosure. The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A belt comprising:

a vertically-extending first end;

a vertically-extending second end spaced apart from the first end;

a horizontally- and vertically-extending elongate member comprising a first surface and a second surface facing away from the first surface, the elongate member having an elongate-member horizontal length between the first end and the second end and an elongate-member vertical width;

a reinforcement region on or in the elongate member, the reinforcement region having a reinforcement-region length less than the elongate-member length and a reinforcement-region height substantially equal to the elongate-member width, and the reinforcement region comprising a vertically-extending first edge facing the first end and a vertically-extending second edge facing the second end;

a first portion adjacent the first end, the first portion comprising a hook or pile first fabric on the first surface having a size defined by a first area;

a second portion proximal the first edge of the reinforcement region, the second portion comprising a hook or pile second fabric on the first surface having a size defined by a second area larger than the first area, the second fabric configured, in use, to join with the first fabric and;

a third portion adjacent the second end, the third portion comprising a hook or pile third fabric on the second surface having a size defined by a third area; and a fourth portion proximal the second edge of the reinforcement region, the fourth portion comprising a hook or pile fourth fabric on the second surface having a size defined by a fourth area larger than the third area, the fourth fabric configured, in use, to join with the third fabric, the elongate member comprising a first attachment region between the first portion and the second portion, the first attachment region having sufficient flexibility to allow, in use, for folding at least part of the first attachment region around a first attachment point on a wearer's clothing proximal a wearer's hip and joining the first fabric and the second fabric, thereby anchoring the belt at the first attachment point, and a second attachment region between the third portion and the fourth portion, the second attachment region having sufficient flexibility to allow, in use, for folding at least part of the second attachment region around a second attachment point on the wearer's clothing proximal the wearer's navel and joining the third fabric and the fourth fabric, thereby anchoring the belt at the second attachment point.

2. The belt of claim 1, wherein the elongate member comprises an elongate fabric strip.

3. The belt of claim 2, wherein the elongate fabric strip is a single layer.

4. The belt of claim 1, the second end having a rounded or tapered shape.

5. The belt of claim 1, the reinforcement region comprising one or more layers of reinforcing fabric strips.

6. The belt of claim 5, the one or more layers comprising at least one reinforcing nylon strip.

7. The belt of claim 1, wherein the first fabric is a hook fabric and the second fabric is a pile fabric.

8. The belt of claim 1, wherein the third fabric is a hook fabric and the fourth fabric is a pile fabric.

9. The belt of claim 1, wherein at least part of the reinforcement region extends on or in the elongate member adjacent the fourth portion.

10. The belt of claim 1, further comprising a webbing material on at least part of the first surface or at least part of the second surface.

11. A belt comprising:

a first end;

a second end spaced apart from the first end;

an elongate member extending between the first end and the second end, comprising a first surface and a second surface facing away from the first surface;

a first portion adjacent the first end, the first portion comprising a first means for joining on the first surface;

a second portion spaced apart from the first portion by a first attachment region of the elongate member, the second portion comprising a second means for joining on the first surface, the second joining means compliant with the first joining means, and the first attachment region sufficiently flexible to allow, in use, for folding at least part of the first attachment region around a first attachment point on a wearer's clothing and joining the first joining means and the second joining means, thereby anchoring the belt at the first attachment point;

a third portion adjacent the second end, the third portion comprising a third joining means on the second surface; and a fourth portion spaced apart from the third portion by a second attachment region of the elongate member, the fourth portion comprising a fourth joining means on the second surface, the fourth joining means compliant with the third joining means, and the second attachment region having sufficient flexibility to allow, in use, for folding at least part of the second attachment region around a second attachment point on the wearer's clothing and joining the third joining means and the fourth joining means, thereby anchoring the belt at the second attachment point.

12. The belt of claim 11, wherein the elongate member comprises an elongate fabric strip.

13. The belt of claim 12, wherein the elongate fabric strip is a single layer of nylon.

14. The belt of claim 11, the second end having a rounded or tapered shape.

15. The belt of claim 11, further comprising a reinforcement region on or in the elongate member.

16. The belt of claim 15, the reinforcement region having a length less than a length of the elongate member.

17. The belt of claim 15, the reinforcement region comprising a first edge facing the first end and a second edge facing the second end, the second portion proximal the first edge, and the fourth portion proximal the second edge.

18. The belt of claim 15, the reinforcement region overlapping a midpoint of the elongate member.

* * * * *